US008919449B2

(12) United States Patent
Gonzalez et al.

(10) Patent No.: US 8,919,449 B2
(45) Date of Patent: Dec. 30, 2014

(54) OFFSHORE DRILLING AND PRODUCTION SYSTEMS AND METHODS

(75) Inventors: Romulo Gonzalez, Slidell, LA (US); Gwo-Tarng Ju, Katy, TX (US); Edward Eugene Shumilak, II, Houston, TX (US)

(73) Assignee: Shell Oil Company, Houston, TX (US)

( * ) Notice: Subject to any disclaimer, the term of this patent is extended or adjusted under 35 U.S.C. 154(b) by 793 days.

(21) Appl. No.: 12/995,976

(22) PCT Filed: May 29, 2009

(86) PCT No.: PCT/US2009/045585

§ 371 (c)(1),
(2), (4) Date: Feb. 16, 2011

(87) PCT Pub. No.: WO2009/148943

PCT Pub. Date: Dec. 10, 2009

(65) Prior Publication Data

US 2011/0132615 A1 Jun. 9, 2011

Related U.S. Application Data

(60) Provisional application No. 61/058,342, filed on Jun. 3, 2008.

(51) Int. Cl.

| | |
|---|---|
| ***E21B 43/017*** | (2006.01) |
| ***E21B 33/035*** | (2006.01) |
| ***E21B 19/00*** | (2006.01) |
| ***E21B 43/01*** | (2006.01) |
| ***E21B 43/26*** | (2006.01) |

(52) U.S. Cl.

CPC ..... *E21B 33/035* (2013.01); *E21B 19/002* (2013.01); *E21B 43/01* (2013.01); *E21B 43/017* (2013.01); *E21B 43/26* (2013.01)

USPC ..... 166/366; 166/345; 166/357; 166/358; 166/369; 175/5

(58) Field of Classification Search

CPC .... E21B 19/002; E21B 33/035; E21B 43/017

USPC ..... 166/366, 344, 345, 352, 357, 358, 369, 166/75.12; 175/5, 7, 9, 206; 405/224.2–224.4

See application file for complete search history.

(56) References Cited

U.S. PATENT DOCUMENTS

| | | | | |
|---|---|---|---|---|
| 3,658,231 | A | 4/1972 | Gilman | |
| 4,192,383 | A | 3/1980 | Kirkland et al. | |
| 4,527,632 | A * | 7/1985 | Chaudot | 166/357 |

(Continued)

FOREIGN PATENT DOCUMENTS

| | | | |
|---|---|---|---|
| CN | 1184526 | 6/1998 | |
| CN | 101501385 | 8/2009 | |
| WO | WO2008036740 | 3/2008 | B01D 29/03 |
| WO | WO2008042943 | 4/2008 | E02B 1/00 |

*Primary Examiner* — Matthew Buck

(57) ABSTRACT

A method of drilling and producing from an offshore structure, comprising drilling a first well from the offshore structure with a drilling riser; completing the first well with a first subsurface tree; connecting the first subsurface tree to a manifold; drilling a second well from the offshore structure with a drilling riser; completing the second well with a second subsurface tree; connecting the second subsurface tree to the manifold; and connecting a production riser to the manifold and the offshore structure.

11 Claims, 9 Drawing Sheets

(56) References Cited

U.S. PATENT DOCUMENTS

| | | | | | |
|---|---|---|---|---|---|
| 4,705,114 | A * | 11/1987 | Schroeder et al. | 166/357 |
| 4,819,730 | A * | 4/1989 | Williford et al. | 166/355 |
| 4,967,843 | A * | 11/1990 | Corteville et al. | 166/366 |
| 4,972,907 | A | 11/1990 | Sellars, Jr. | |
| 4,982,794 | A * | 1/1991 | Houot | 166/357 |
| 5,195,848 | A | 3/1993 | Huete et al. | |
| 6,213,215 | B1 * | 4/2001 | Breivik et al. | 166/350 |
| 6,230,810 | B1 * | 5/2001 | Rivas | 166/357 |
| 6,336,238 | B1 | 1/2002 | Tarlton | |
| 6,336,421 | B1 * | 1/2002 | Fitzgerald et al. | 114/264 |
| 6,494,271 | B2 * | 12/2002 | Wilson | 175/5 |
| 6,497,286 | B1 * | 12/2002 | Hopper | 166/368 |
| 6,688,392 | B2 * | 2/2004 | Shaw | 166/366 |
| 6,725,936 | B2 * | 4/2004 | Hopper | 166/366 |
| 6,968,902 | B2 * | 11/2005 | Fenton et al. | 166/358 |
| 7,011,152 | B2 * | 3/2006 | Soelvik | 166/65.1 |
| 7,073,593 | B2 * | 7/2006 | Hatton et al. | 166/367 |
| 7,093,661 | B2 * | 8/2006 | Olsen | 166/357 |
| 7,150,325 | B2 * | 12/2006 | Ireland et al. | 166/366 |
| 7,240,735 | B2 | 7/2007 | Crozier | |
| 7,240,736 | B2 * | 7/2007 | Fenton et al. | 166/358 |
| 7,296,629 | B2 | 11/2007 | Bartlett | 166/348 |
| 7,314,084 | B2 | 1/2008 | Rodrigues et al. | 166/344 |
| 7,434,624 | B2 * | 10/2008 | Wilson | 166/368 |
| 7,628,224 | B2 * | 12/2009 | D'Souza et al. | 175/5 |
| 7,793,724 | B2 * | 9/2010 | Daniel et al. | 166/366 |
| 7,882,896 | B2 * | 2/2011 | Wilson et al. | 166/368 |
| 7,958,938 | B2 * | 6/2011 | Crossley et al. | 166/366 |
| 2001/0013414 | A1 * | 8/2001 | Fitzgerald et al. | 166/366 |
| 2004/0238176 | A1 * | 12/2004 | Appleford et al. | 166/353 |

* cited by examiner

OFFSHORE DRILLING AND PRODUCTION SYSTEMS AND METHODS

The present application claims priority from U.S. Provisional Patent Application 61/058,342 filed 3 Jun. 2008.

FIELD OF THE INVENTION

Embodiments disclosed herein relate generally to subsea well production. In particular, embodiments disclosed herein relate to direct vertical access drilling and production systems.

BACKGROUND OF THE INVENTION

WO 2008/042943 A2 discloses a floating system positioned in a body of water having a water bottom, the system comprising a host member floating on a surface of the water; a flotation module floating under the surface of the water; a flexible hose connecting the host member to the flotation module; and an elongated underwater line structure, comprising a top portion connected to the flotation module; a bottom portion extending to the water bottom and adapted to connect to a flowline lying on the water bottom; and at least one of the top portion and the bottom portion comprising a catenary configuration. WO 2008/042943 A2 is herein incorporated by reference in its entirety.

WO 2008/036740 A2 discloses a system comprising a mobile offshore drilling unit, a first group of wells drilled by the mobile offshore drilling unit, a second group of wells drilled by the mobile offshore drilling unit, wherein the mobile offshore drilling unit comprises processing equipment adapted to process production from the first group of wells and the second group of wells. WO 2008/036740 A2 is herein incorporated by reference in its entirety.

U.S. Pat. No. 7,314,084 discloses a system comprising a pumping module coupled to an intermediate flow inlet (IFI) wherein said IFI is coupled to a base structure disposed on the flow line that routes production from one or more oil wells, allowing for the quick and easy installation or recovery of a subsea pumping module by cable from an inexpensive vessel. The disclosure also allows for the hydraulic isolation of the subsea pumping module by means of on-off valves on the IFI whereby the pumping module can be easily installed or removed without causing underwater oil spills. Sealing of the connection is of the metal-metal type. It is also possible to pass a pig through the present system for clearing the flow lines. U.S. Pat. No. 7,314,084 is herein incorporated by reference in its entirety.

U.S. Pat. No. 7,296,629 discloses a subsea production system that is adapted to be coupled to a subsea wellhead and includes a tubing hanger adapted to be positioned in the wellhead. The tubing hanger has a flow opening extending therethrough and has at least one eccentrically located opening extending through the tubing hanger. In some cases, the tubing hanger is adapted to be not precisely oriented with respect to a fixed reference point when positioned in the wellhead. The system also includes a production tree adapted to be operatively coupled to the tubing hanger, wherein the production tree is oriented relative to the tubing hanger. U.S. Pat. No. 7,296,629 is herein incorporated by reference in its entirety.

U.S. Pat. No. 7,240,736 discloses subsea wells that are drilled and completed with an offshore floating platform in a manner that allows simultaneous work on more than one well. A first well is drilled and casing. Then a tubing hanger is run through a drilling riser and landed in the wellhead housing.

Then, with the same floating platform, the drilling riser is disconnected and moved to a second well. While performing operations on the second well, the operator lowers a production tree from the floating platform on a lift line, and connects it to the first wellhead housing. An ROV assisted subsea plug removal tool is used for plug removal and setting operations required through the production tree. U.S. Pat. No. 7,240,736 is herein incorporated by reference in its entirety.

U.S. Pat. No. 7,150,325 discloses a subsea pumping assembly locates on a seafloor for pumping well fluid from subsea wells to the level. The pumping assembly has a tubular outer housing that is at least partially embedded in the seafloor. A tubular primary housing locates in the outer housing and has a lower end with a receptacle. An annular space surrounds the primary housing within the outer housing for delivering fluid to a receptacle at the lower end of the primary housing. A capsule is lowered in and retrieved from the primary housing. The capsule sealingly engages the receptacle for receiving well fluid from the annular space. A submersible pump is located inside the capsule. The pump has an intake that receives well fluid and a discharge that discharges the well fluid exterior of this capsule. The capsule has a valve in its inlet that when closed prevents leakage of well fluid from the capsule. The capsule may be retrieved through open sea without a riser. U.S. Pat. No. 7,150,325 is herein incorporated by reference in its entirety.

U.S. Pat. No. 7,093,661 discloses methods and arrangements for production of petroleum products from a subsea well. The methods comprise control of a downhole separator, supplying power fluid to a downhole turbine/pump hydraulic converter, performing pigging of a subsea manifold, providing gas lift and performing three phase downhole separation. Arrangement for performing the methods are also described. U.S. Pat. No. 7,093,661 is herein incorporated by reference in its entirety.

U.S. Pat. No. 6,968,902 discloses that subsea wells are drilled and completed with an offshore floating platform in a manner that allows simultaneous work on more than one well. A first well is drilled and cased. Then a tubing hanger is run through a drilling riser and landed in the wellhead housing. Then, with the same floating platform, the drilling riser is disconnected and moved to a second well. While performing operations on the second well, the operator lowers a production tree from the floating platform on a lift line, and connects it to the first wellhead housing. An ROV assisted subsea plug removal tool is used for plug removal and setting operations. Seabed separation is configured upstream of a production choke valve. U.S. Pat. No. 6,968,902 is herein incorporated by reference in its entirety.

Accordingly, there exists a need in the art for systems and methods to provide more efficient offshore drilling and production.

Accordingly, there exists a need in the art for reducing the number of risers needed to drill and produce oil from an offshore structure.

Accordingly, there exists a need in the art for providing lower cost offshore structures for drilling and producing oil. These and other needs of the present disclosure will become apparent to those of skill in the art upon review of this specification, including its drawings and claims.

SUMMARY OF THE INVENTION

In one aspect, the present invention relates to a method of drilling and producing from an offshore structure, comprising drilling a first well from the offshore structure with a drilling riser; completing the first well with a first subsurface tree;

connecting the first subsurface tree to a manifold; drilling a second well from the offshore structure with a drilling riser; completing the second well with a second subsurface tree; connecting the second subsurface tree to the manifold; and connecting a production riser to the manifold and the offshore structure.

In another aspect, the present invention relates to a method of producing from an offshore structure, comprising drilling a first well from a drill ship; completing the first well with a first subsurface tree; connecting the first subsurface tree to a manifold; drilling a second well from the drill ship; completing the second well with a second subsurface tree; connecting the second subsurface tree to the manifold; and connecting a production riser to the manifold and the offshore structure.

In another aspect, the present invention relates to a system for drilling and producing oil and/or gas, comprising an offshore structure located in a body of water; a first well comprising a first subsurface tree; a second well comprising a second subsurface tree; a manifold connected to the first well and the second well; and a production riser connected to the manifold and the offshore structure.

Other aspects and advantages of the invention will be apparent from the following description and the appended claims.

DETAILED DESCRIPTION OF THE INVENTION

Figure 1:
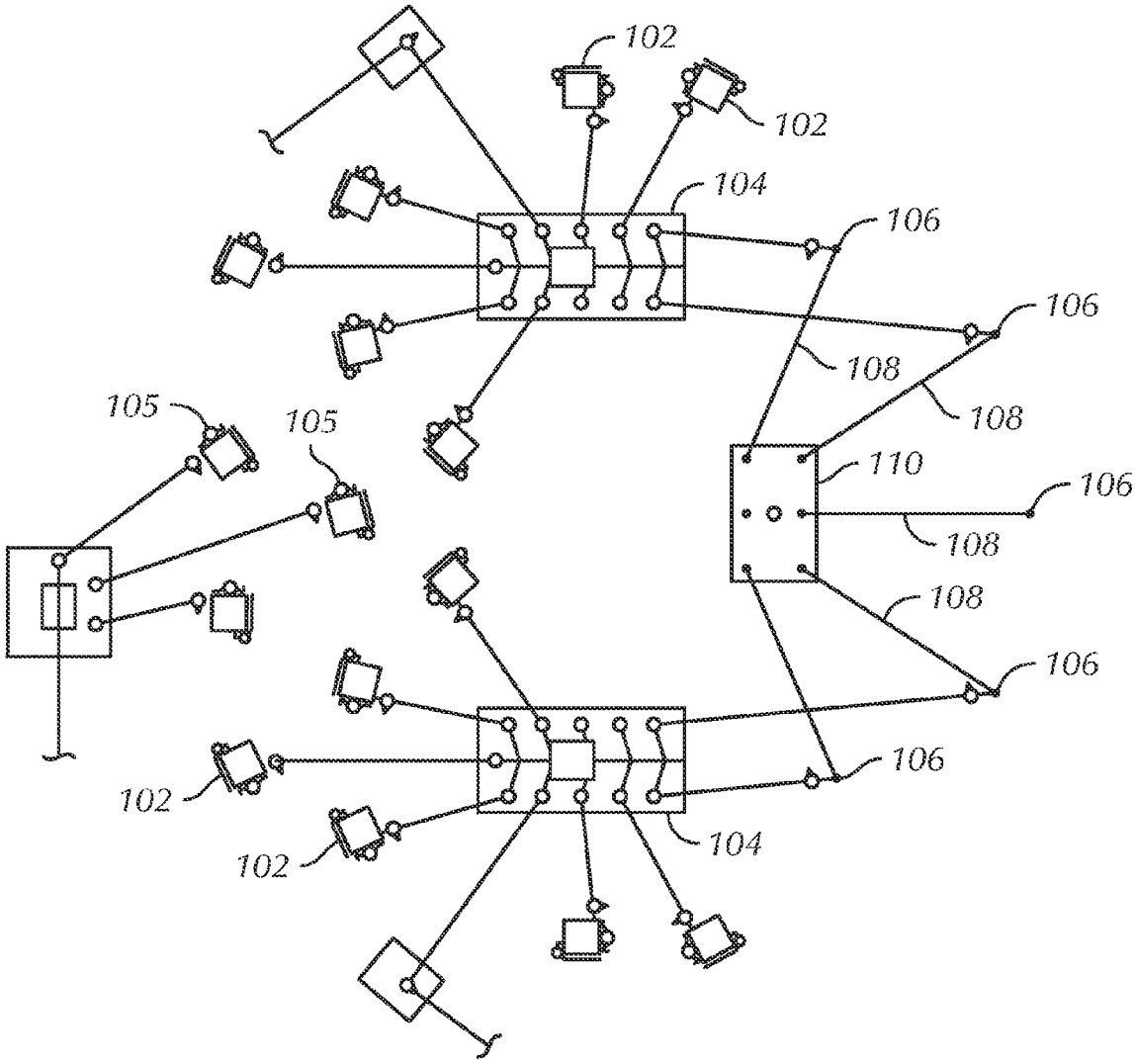
FIG. 1 shows a seafloor layout of a wet-tree DVA production system in accordance with embodiments disclosed herein.

Specific embodiments of the present invention will now be described in detail with reference to the accompanying figures. Like elements in the various figures may be denoted by like reference numerals for consistency.

In one aspect, embodiments disclosed herein relate to a wet-tree direct vertical access (DVA) production system. In another aspect, embodiments disclosed herein relate to a subsea boosting system and a method for providing artificial lift in transferring production fluids from a seafloor to a production platform.

Generally, conventional dry-tree DVA systems include low heave platforms that include a well deck where surface (dry) trees are mounted on top of risers. Crude oil from one or more subsea wells is connected in a manifold disposed on a production deck of the platform and conveyed to a processing facility to separate oil from entrained water and gas. Each well has a vertical riser that extends from the wellhead to a slot formed in the platform for transferring the crude oil. Thus, the number of wells that can be drilled and/or completed by a platform rig may be limited by the number of slots or the size of a well bay.

Figure 9:
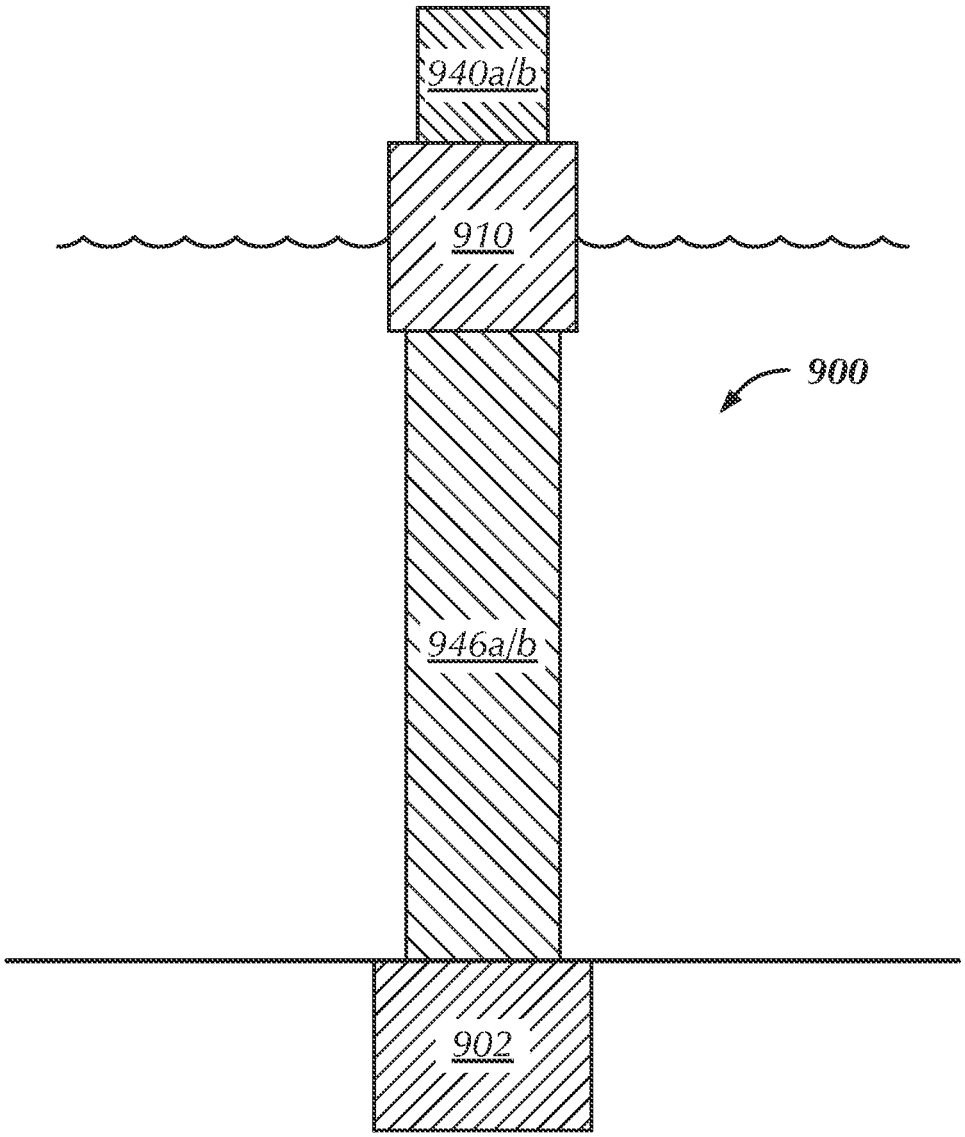
FIG. 9 shows a schematic view of a dry-tree DVA system.

FIG. 9:

FIG. 9 shows a schematic view of a dry-tree DVA system 900. Traditionally, a well 902 is drilled from a host 910, for example a drilling platform, with a drilling riser 946*a* and a surface BOP 940*a*. After the well 902 is completed, drilling riser 946*a* may be replaced with a production riser 946*b*. Additionally, surface BOP 940*a* may be replaced with a surface tree 940*b*. Thus, liquids and/or gases may be produced from well 902 to host 910 by production riser 946*b* and surface tree 940*b*.

As discussed, this system assembly arrangement may be limited in the number of wells that can be drilled and completed by the number of available slots and the size of the moonpool in host 910.

In contrast, a wet-tree DVA systems may include subsea trees that are connected to wells arranged on the seafloor. Produced crude oil may be transferred along the seafloor via flow lines and collected in a manifold. Production risers convey the production fluid from the manifold or subsea trees to process equipment disposed on the production platform. Therefore, the number of risers in a wet-tree DVA system is dependent on the total throughput of the facility, and not by the number of wells.

Figure 10:
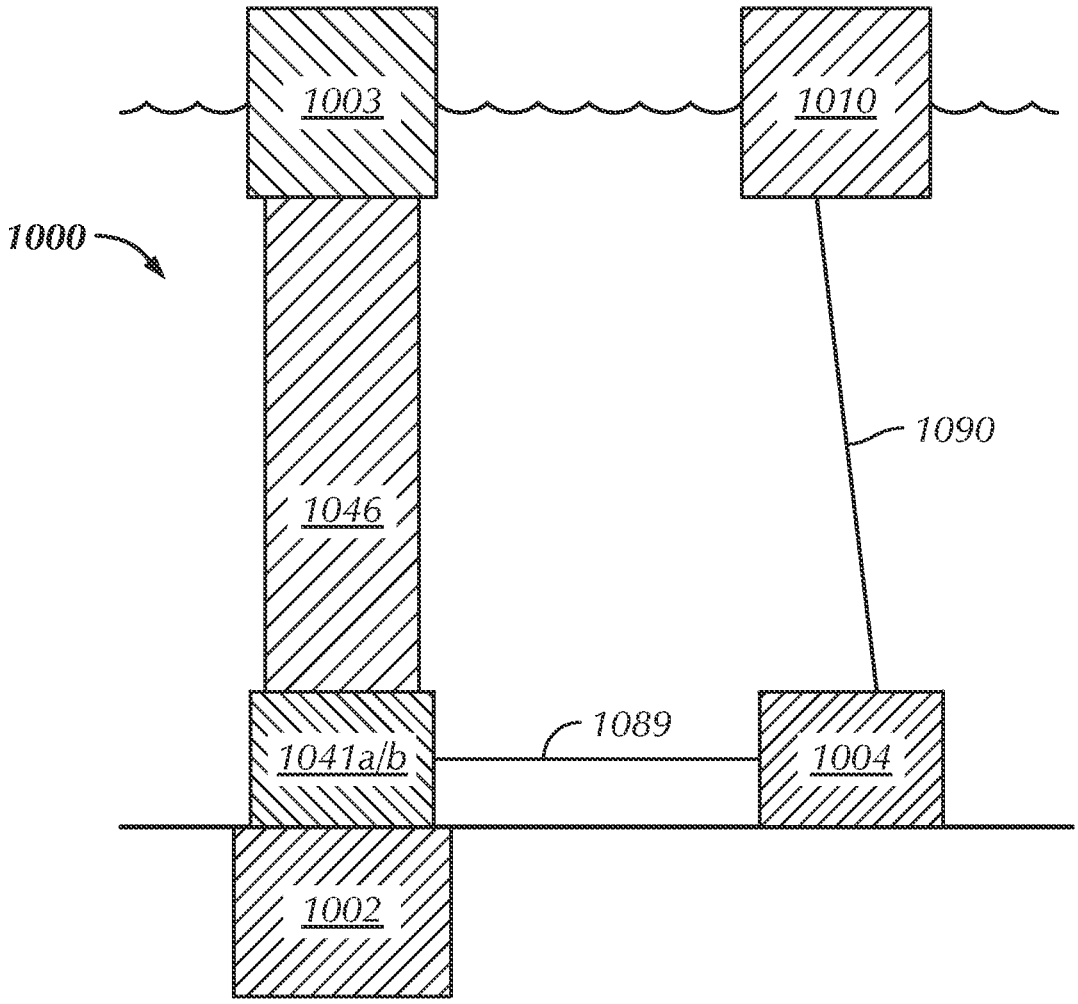
FIG. 10 shows a schematic view of a wet-tree DVA system.

FIG. 10:

Referring now to FIG. 10, a schematic view of a wet-tree DVA system 1000 is shown. In this traditional system assembly arrangement, a drill vessel 1003 (i.e., drill ship) with a drilling riser 1046 and a subsurface BOP 1041*a* is used to drill a well 1002. After well 1002 is complete, subsurface BOP 1041*a* is replaced with a subsurface tree 1041*b*. A first flow line 1089 fluidly connects subsurface tree 1041*b* to a manifold 1004 and a second flow line 1090 fluidly connects manifold 1004 to a host 1010 to provide production of liquids and/or gases from well 1002 to host 1010.

In the assembly arrangement shown in FIG. 10, system 1000 requires both a drill vessel 1003 and a host 1010. Drill vessel 1003 is required to perform drilling operations of well 1002, while host 1010, i.e., production platform, is required to produce and receive the liquids and/or gases from well 1002.

FIG. 11

Figure 11:
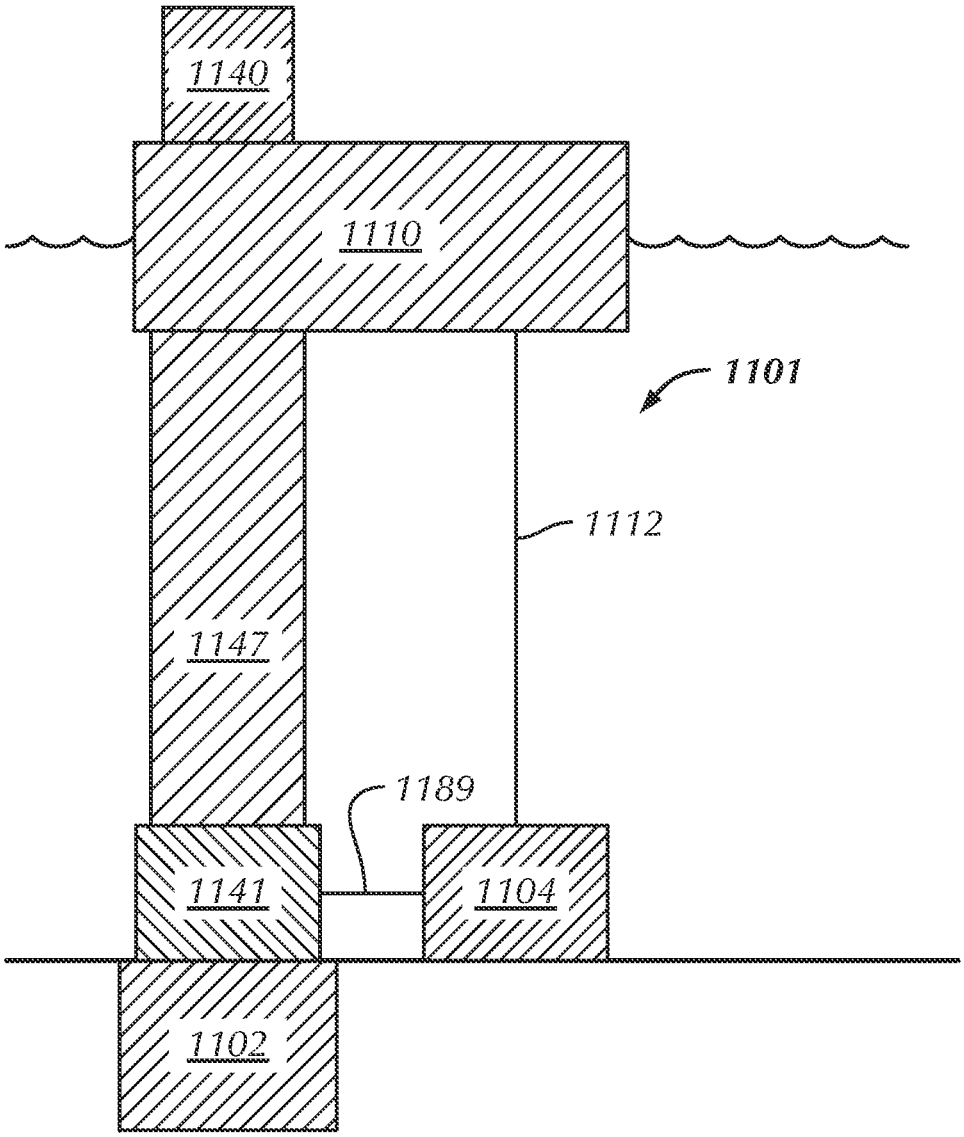
FIG. 11 shows a schematic view of a DVA system in accordance with embodiments disclosed herein.

Referring now to FIG. 11, a schematic view of a DVA system 1101 in accordance with embodiments disclosed herein is shown. In the embodiment shown, the DVA system 1101 includes a host 1110, a surface BOP 1140 and a drilling riser 1147 configured to drill a well 1102. After well 1102 is complete, a subsurface tree 1141 may be installed proximate well 1102. A flow line 1189 fluidly connects the subsurface tree 1141 to a manifold 1104. A vertical caisson 1112 is provided to connect manifold 1104 to host 1110. In one embodiment, vertical caisson 1112 may include an electrical submersible pump (ESP) to pump, or pressure boost, production liquid upward to process facilities disposed on the production platform, as discussed in more detail below. In another embodiment, caisson 1112 may also be used as a gas-liquid separator. Further examples of ESPs are described in greater detail below.

After well 1102 is complete, drilling riser 1147 may be used to drill additional wells. In contrast to DVA system 900 shown in FIG. 9, DVA system 1101 of FIG. 11, in accordance with embodiments disclosed herein, provides aggregation of multiple wells at manifold 1104 and production of gas/liquids to host 1110 via vertical caisson 1112. As such, each well may not be required to use a production riser to produce gas/liquids to the host. As discussed above, the use of production risers typically limits the possible number of wells produced within a general DVA system based upon limitations of sizes and configurations of the host. Thus, by aggregating multiple wells via the vertical caisson, these limitations may be avoided and the number of wells produced may be increased. Additional embodiments are discussed in more detail below.

FIG. 1:

Referring now to FIG. 1, a seafloor layout, or top-down view of a wet-tree DVA production system in accordance with embodiments disclosed herein is shown. A plurality of subsea production wells 102 are fluidly connected to a manifold 104. In one embodiment, manifold 104 may be a dual-header manifold. In this embodiment, production fluids from each subsea production well 102 fluidly connected to manifold 104 are comingled or combined within manifold 104. Commingling of production fluids may advantageously eliminate the need for continuous hydrate inhibition. The comingled production fluid is then transferred through tubing to a subsea boosting system 106 configured to return the production fluid through a top-tensioned riser 108 to a DVA host 110, for example, a TLP, semi-sub, spar, or production platform. In one embodiment, a plurality of subsea water injection wells 105 may be disposed proximate the production wells and fluidly connected to manifold 104.

Figure 2:
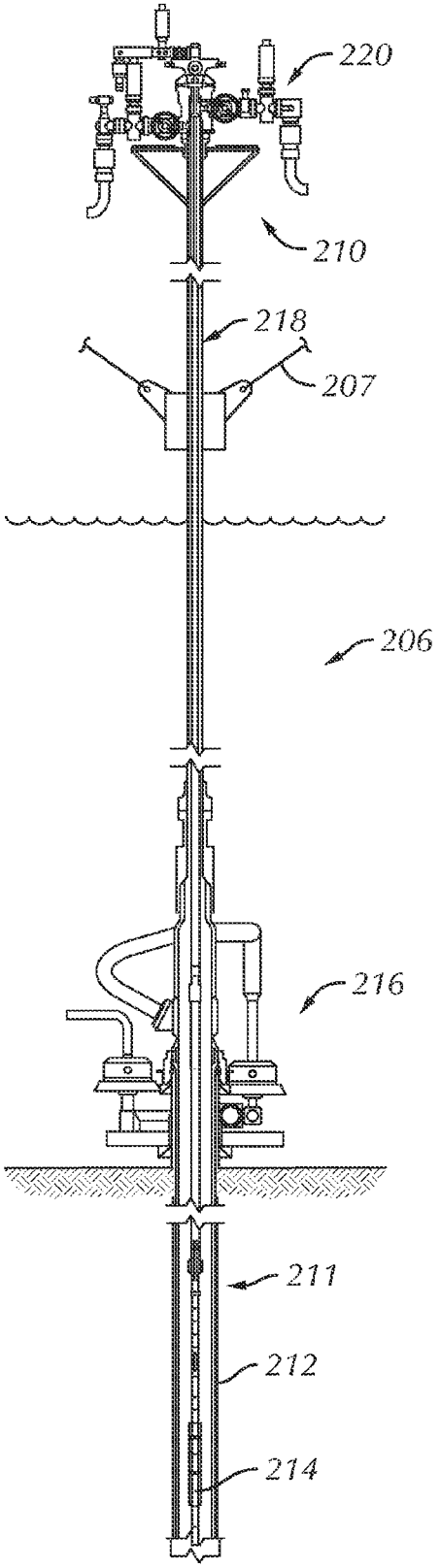
FIG. 2 shows a side-view of a subsea boosting system in accordance with embodiments disclosed herein.

FIG. 2:

Referring now to FIG. 2, a cross-sectional view of a subsea boosting system 206 in accordance with embodiments disclosed herein is shown. Subsea boosting system 206 provides an artificial lift system for returning produced fluids from subsea wells to a production platform 210. As known in the art, production platform 210 may include, for example, a tension leg platform (TLP) or a spar configured to receive and process production fluids. In the embodiment shown, subsea boosting system 206 includes an outflow assembly 211 having an ESP 214 disposed in a caisson 212 inserted in a seafloor. Subsea boosting system 206 further includes an annular degasser 216, a production riser 218, and a surface flow control assembly 220. These components of the subsea boosting system 206 are described in greater detail below.

Figure 3:
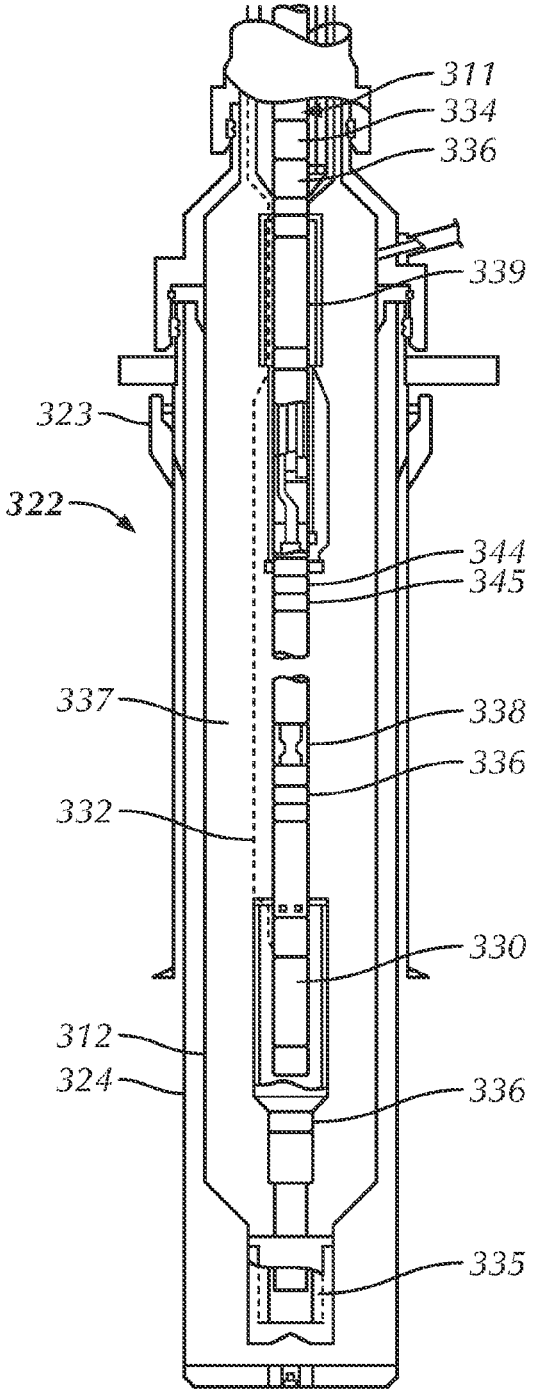
FIG. 3 shows a side-view of an outflow assembly in accordance with embodiments disclosed herein.

FIG. 3:

Referring to FIG. 3, a side-view of an outflow assembly 311 disposed in caisson 312 in accordance with embodiments disclosed herein is shown. Outflow assembly 311 and caisson 312 are inserted in an outer housing assembly 322. Outer housing assembly 322 includes a conductor 323 inserted into the seafloor with a casing 324 inserted and cemented therein. Outer housing assembly 322 may provide a foundation for landing and supporting caisson 312. One of ordinary skill in the art will appreciate that the dimensions (e.g., diameters and lengths) of the outer housing assembly 322 components may vary based on, for example, formation properties of the seafloor, production specifications, size and number of components (e.g., caisson and pumps) disposed therein, and other similar properties of the DVA production system and surrounding environment. In one example, conductor 323 may include a 48 inch tubular and may be inserted to a depth of approximately 200 feet below mudline. As such, casing 324 may include a 42 inch tubular inserted to a depth of 350 feet below mudline.

Figure 4:
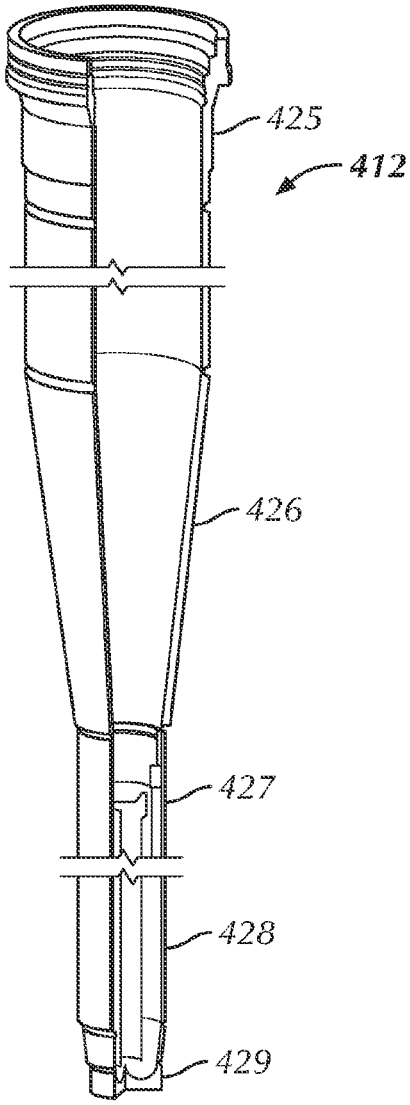
FIG. 4 shows a perspective view of a caisson in accordance with embodiments disclosed herein.

FIG. 4:

Referring now to FIG. 4, a perspective view of a caisson 412 in accordance with embodiments disclosed herein is shown. Caisson 412 may include at least one length of straight tubular and at least one length of tapered tubular. Specifically, as shown, caisson 412 may include a first section 425 having a length of straight tubular, a second section having a length of tapered tubular, i.e., first reducer 426, a third section 427 having a length of straight tubular, and a fourth section having a length of tapered tubular, i.e., a second reducer 428. The lengths of straight and tapered tubular sections are configured so as to decrease the radial opening of caisson 412 in an axially downward direction. A flow diver 429 may be disposed axial below second reduce 428.

One of ordinary skill in the art will appreciate that the dimensions (e.g., diameter, length, and wall thickness) of caisson 412 may vary based on, for example, the diameter and length of outer housing assembly 322 (FIG. 3), production specifications, the size and length of components disposed therein, and other similar properties of the DVA production system and surrounding environment. In one example, caisson 412 may be over 300 feet in length. As such, the first section 425 of caisson 412 may have an outside diameter of 36 inches, first reducer 426 may include a 15 degree opening, third section 427 may have a 16 inch diameter, and second reducer may also include a 15 degree opening. In one embodiment, caisson 412 may contain a total volume of more than 200 barrels (bbls). For example, caisson 412 may contain a total volume of at least about 300 bbls. One of ordinary skill in the art will appreciate that the number of sections, the lengths of each section, and the degrees of opening on the reducers may vary without departing from the scope of embodiments disclosed herein. The configuration of caisson 412 may reduce surging or slugging of production fluids lifted to the production platform (210 in FIG. 2), thereby providing a more continuous flow of production fluids.

FIG. 3:

Referring back to FIG. 3, caisson 312 is configured to house outflow assembly 311. Outflow assembly 311 may include at least one ESP 330 configured to pump, or pressure boost, production liquid upward to process facilities disposed on the production platform. In one embodiment, caisson 312 may be configured to house two ESP's in series. For example, caisson 312 may house two 1500 HP ESP's 330 in series. Examples of a commercially available ESP's are those sold by Schlumberger (Houston, Tex.). ESP 330 may be driven by asynchronous alternating current using variable frequency by providing a variable speed motor to drive the pump. Thus, a variable pressure increase may be provided to the flow of the production fluid. An ESP power cable 332 may then electrically connect ESP 330 to the production platform to provide electric power to an ESP motor (not independently illustrated).

ESP 330 may include a centrifugal type pump, a progressing cavity type pump, or any other pump known in the art. In one embodiment, the ESP 330 may include a centrifugal type pump having a plurality of stages, each stage having an impeller and a diffuser. ESP 330 includes an intake (not shown) disposed at a lower end proximate a lower end of caisson 312. Further, a seal section (not shown) may be secured to a lower end of ESP 330. The seal section may include a thrust bearing to accommodate downward thrust of ESP 330.

As shown, a strainer 335 may be disposed below ESP 330 to filter any large particles from entering ESP 330, thereby preventing possible plugs or damage to ESP 330. Outflow assembly 311 may then include a plurality of level gages 336 to measure the amount of production fluid in caisson 312. Thus, the amount of production fluid may be monitored so as to ensure optimal operating conditions for ESP 330. Additionally, a flow meter 338 may be disposed above ESP 330 to measure the flow rate of the production fluids being pumped upward. A check valve 344, disposed above ESP 330 may also be used to prevent production fluid from flowing in the reverse direction, i.e., downward, when ESP 330 is not in use. Further, as shown, an injection valve 345 may be disposed above ESP 330 to inject chemicals or additives into the production fluid. In one embodiment, injection valve 345 may inject methanol to prevent gas hydrate formation. A protective layer 339 may be disposed over outflow assembly 311 to protect the assembly, and in particular, the power output end of the motor shaft, to prevent well fluid from entering the assembly 311.

Figure 5:
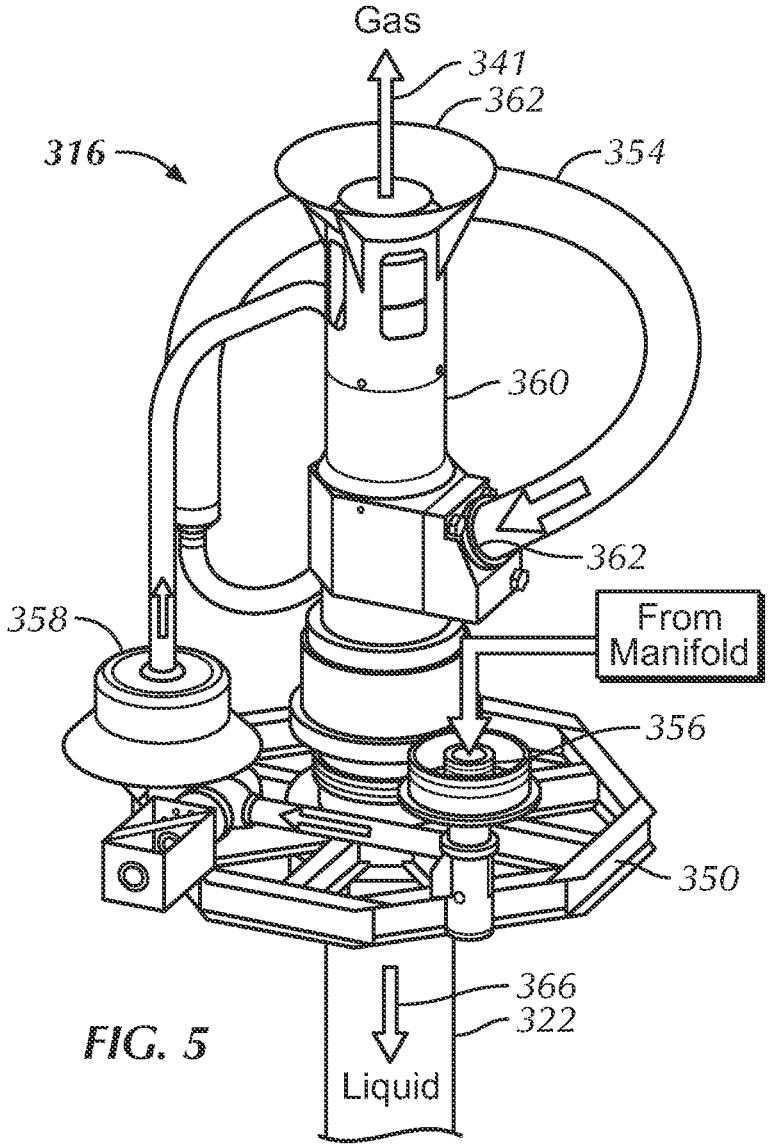
FIG. 5 shows a perspective view of an annular degasser in accordance with embodiments disclosed herein.

FIGS. 5 & 6:

Referring now to FIG. 5, a perspective view of an annular degasser 316 in accordance with embodiments disclosed herein is shown. Annular degasser 316 may include a flow base 350 and a body 360 coupled to outer housing assembly 322. Body 360 of annular degasser 316 may include a series of straight tubular pieces or forged bodies. A connector 362 is coupled to an upper end of body 360 and is configured to connect to a top-tensioned riser (218 in FIG. 2) for fluid connection between caisson 312 and a production platform (210 in FIG. 2).

Figure 6:
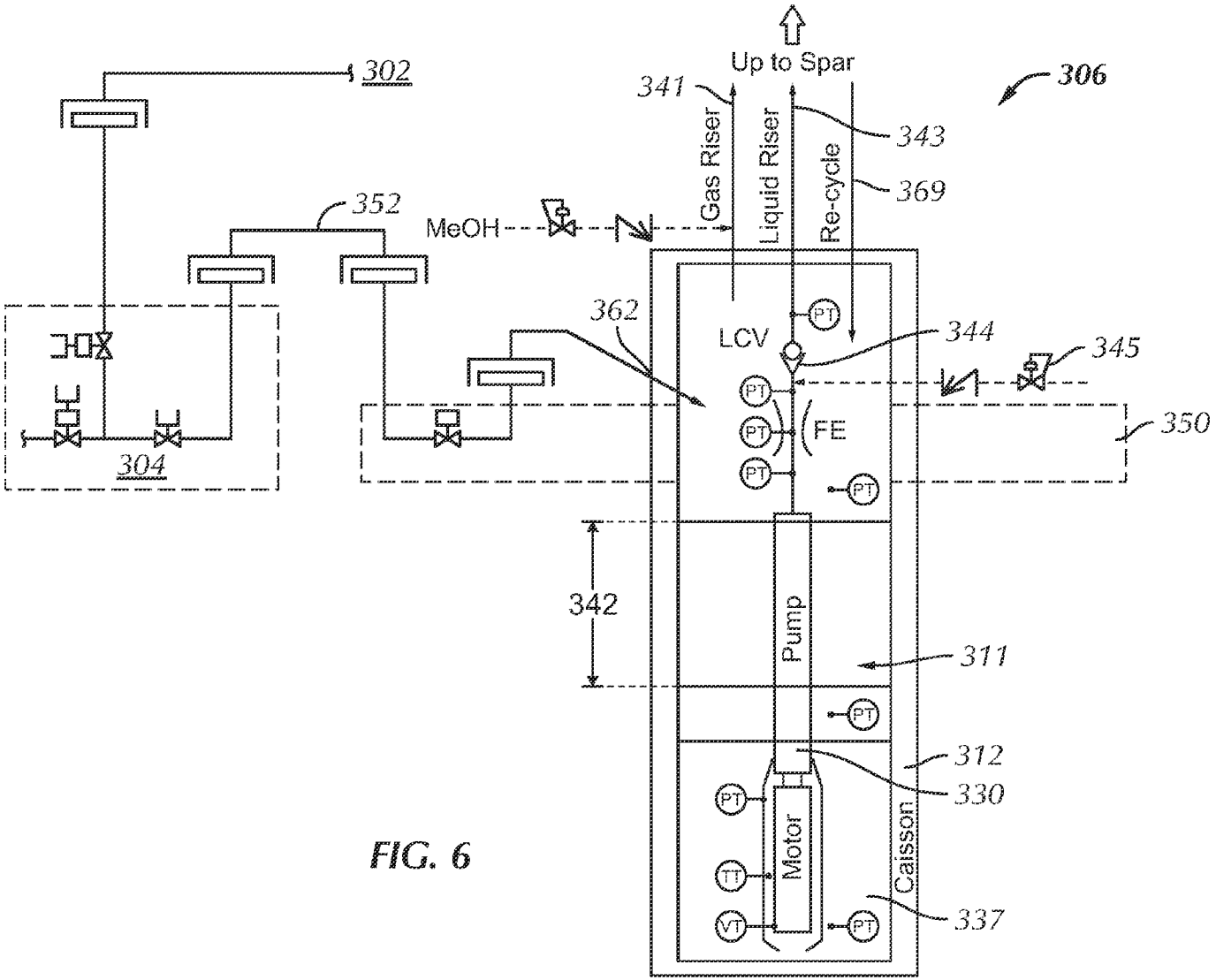
FIG. 6 shows a partial schematic view of a subsea boosting system in accordance with embodiments disclosed herein.

Referring now to both FIGS. 5 and 6, a perspective view of annular degasser 316 and a partial schematic view of a subsea boosting system 306 are shown. In this embodiment, annular degasser 316 is fluidly connected to manifold 304. Thus, commingled production fluids from a plurality of wells 302 may be transferred from manifold 304 via a jumper 352 to an inlet 356 (shown in FIG. 5) of annular degasser 316. Productions fluids may then be transferred by annular degasser 316 in FIG. 5 using a valve 358 and a length of curved tubular 354. Thus, the annular degasser 316 may have a cyclone-type degasser design configured to remove entrained gases from the production fluid. One of ordinary skill in the art will appreciate that any annular degasser may be used without departing from the scope of embodiments disclosed herein. An exit end of curved tubular 354 is fluidly connected to caisson 312 through inlet 362.

As the production fluid flows through the annular degasser 316 and into inlet 362, entrained gases separated from the production fluid naturally travel upward (indicated at 341) through the body 360 of annular degasser 316 and into a gas annulus in a production riser (not shown) connected to connector 362. The remaining production fluid, or liquid, flows (indicated at 366) into outer housing assembly 322 and caisson 312.

Referring now only to FIG. 6, the production liquid flows into an annulus 337 formed between caisson 312 and outflow assembly 311. As discussed above, a plurality of level gages may be disposed in outflow assembly 311 to measure, for example, the minimum and maximum levels of fluids in caisson 312 for efficient pumping of production fluids by ESP 330. ESP 330 may be operated when the level gages 336 indicate that the level of production liquid is within an acceptable operating range 342, so as to avoid, for example, cavitation within ESP 330. Production liquid enters the bottom of the outflow assembly 311 and is pumped upward (indicated at 343) by ESP 330 through a liquid opening or annulus in the production riser (not independently illustrated).

Figure 7:
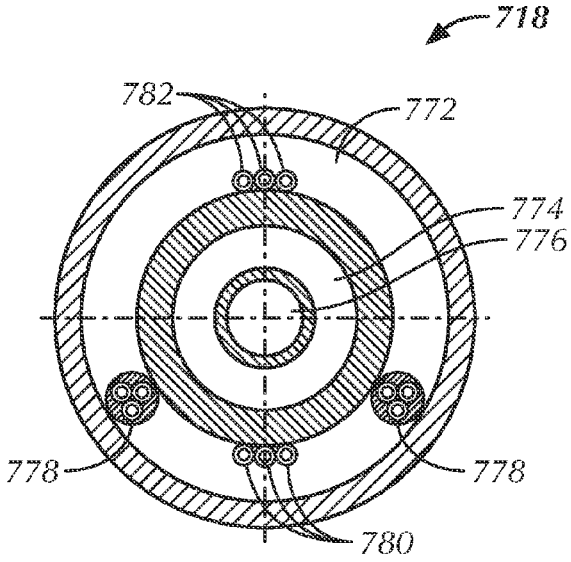
FIG. 7 shows a cross-sectional view of a production riser in accordance with embodiments disclosed herein.

FIG. 7:

Referring to FIG. 7, a cross-sectional view of a production riser 718 in accordance with embodiments disclosed herein is shown. As indicated, production riser 718 may include three concentric tubulars, thereby forming three openings 772, 774, 776. As discussed above, production riser 718 includes a gas annulus 772 and a production liquid annulus 774. Additionally, production riser 718 includes a recycle opening 776 configured to transfer recycled fluids from the surface, or production platform, back down (indicated at 369 in FIG. 6) to the caisson 312 (FIG. 6). Gas naturally flows upward through gas annulus 772 from the annular degasser 316 and caisson 312 (FIGS. 5 and 6). Production liquid is pumped up through production liquid annulus 774 by ESP 330 (FIG. 6).

Further, one or more power cables 778 may be disposed within production riser 718 to supply electric power to ESP 330 (FIG. 3). In one embodiment, power cable 778 may be disposed in gas annulus 772. Data cables 780 may also be disposed within production riser 718 for transferring data from sensors or gages disposed in, for example, caisson 312 or outflow assembly 311 (FIG. 6). In one embodiment, data cables 780 may relay information from level gages disposed on outflow assembly 311 (FIG. 6). As shown, in certain embodiments, data cables 780 may be disposed in gas annulus 772. In some embodiments, chemical injectors 782 may also be disposed in production riser 718, for example, in gas annulus 772. As such, chemical injectors 782 may inject chemicals into the gas and/or production liquids to prevent, for example, hydrates from forming.

In embodiments disclosed herein, production riser 718 includes a top-tensioned riser. One of ordinary skill in the art will appreciate that any type of top-tensioned riser may be used without departing from the scope of embodiments disclosed herein. In one embodiment, top-tensioned riser may include active hydraulic tensioners (207 in FIG. 2) connected to the deck of the production platform, such that the platform may move up and down relative to production riser 718 without moving the production riser 718. In an alternate embodiment, passive buoyancy cans may be coupled to production riser 718. In this embodiment, production riser 718 is independently supported by the buoyancy cans relative to the production platform's hull. Thus, the risers may be isolated from the heave motions of the platform.

Figure 8:
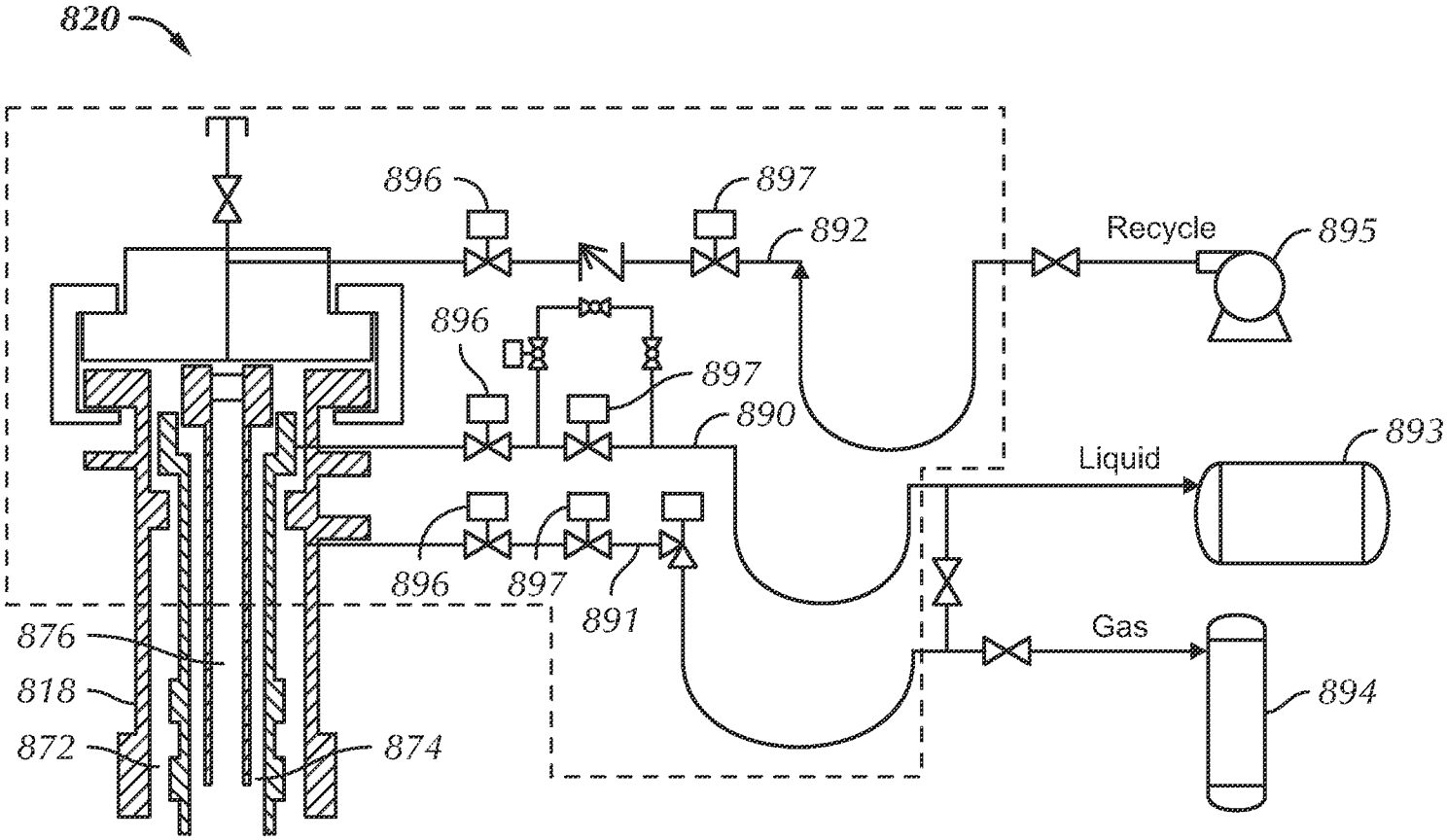
FIG. 8 shows a schematic view of a surface assembly 820 in accordance with embodiments disclosed herein.

FIG. 8:

Referring now to FIG. 8, a schematic view of a surface assembly 820 in accordance with embodiments disclosed herein is shown. Surface assembly 820 is disposed on top of production riser 818 proximate production platform (210 in FIG. 2). Surface assembly 820 includes a plurality of valves and instrumentation to monitor and control the flow of separated production fluids in production riser 818. The plurality of valves may include gate valves, ball valves, and/or check valves, or any other valves known in the art. In one embodiment, surface assembly 820 may include a blowout preventer (BOP). Additionally, surface assembly 820 may include a tubing hanger (not independently illustrated), as is known in the art to suspend the production riser 818. As such, the tubing hanger may then include a sealing system (not shown) configured to hydraulically isolate the production riser 818 and annuli.

Surface assembly 820 may also include a plurality of flow lines for transferring the separated production fluids to storage vessels. Production liquids pumped up through production liquid annulus 874 in production riser 818 may be transferred via a liquid flow line 890 to a production liquid storage vessel 893. Production gases from gas annulus 872 in production riser 818 may be transferred via a gas flow line 891 to a gas storage tank 894. Recycled fluids or makeup oil may be pumped via pump 895 through a fluid flow line 892 into recycle annulus 876 of production riser 818 and down into caisson 312 (FIG. 6). Further, as shown, a plurality of air operated valves 896 and a plurality of shut down valves 897 may be coupled to flow lines 890, 891, 892 to control the flow of liquids and gases transferred to the production platform.

Advantageously, embodiments disclosed herein may provide an artificial lift system that reduces well backpressure and ensures reservoir deliverability. Further, commingling of productions fluids in a subsea boosting system in accordance with embodiments disclosed herein may reduce the need for continuous hydrate inhibition of the production fluid. Furthermore, a wet-tree DVA system in accordance with embodiments disclosed herein may allow for fewer risers, and thereby provide a reduced well bay size and a more economical wet-tree DVA production system.

Illustrative Embodiments

In one embodiment there is disclosed a method of drilling and producing from an offshore structure, comprising drilling a first well from the offshore structure with a drilling riser; completing the first well with a first subsurface tree; connecting the first subsurface tree to a manifold; drilling a second well from the offshore structure with a drilling riser; completing the second well with a second subsurface tree; connecting the second subsurface tree to the manifold; and connecting a production riser to the manifold and the offshore structure. In some embodiments, the method also includes connecting the manifold to a subsea pump. In some embodiments, the method also includes connecting the manifold to a subsea separator. In some embodiments, the method also includes flowing at least a portion of produced gases through a first opening in the production riser. In some embodiments, the method also includes flowing at least a portion of produced fluids through a second opening in the production riser. In some embodiments, the method also includes drilling with a surface blow out preventer. In some embodiments, the offshore structure is floating. In some embodiments, the offshore structure is selected from a tension leg platform, a semi submersible, and a spar.

In one embodiment there is disclosed a method of producing from an offshore structure, comprising drilling a first well from a drill ship; completing the first well with a first subsurface tree; connecting the first subsurface tree to a manifold; drilling a second well from the drill ship; completing the second well with a second subsurface tree; connecting the second subsurface tree to the manifold; and connecting a production riser to the manifold and the offshore structure. In some embodiments, the method also includes connecting the manifold to a subsea pump. In some embodiments, the method also includes connecting the manifold to a subsea separator. In some embodiments, the offshore structure is floating. In some embodiments, the offshore structure is selected from a tension leg platform, a semi submersible, and a spar.

In one embodiment there is disclosed a system for drilling and producing oil and/or gas, comprising an offshore structure located in a body of water; a first well comprising a first subsurface tree; a second well comprising a second subsurface tree; a manifold connected to the first well and the second well; and a production riser connected to the manifold and the offshore structure. In some embodiments, the system also includes a drilling riser connected to the offshore structure and a third well. In some embodiments, the system also includes a subsea pump connected to the manifold and the production riser. In some embodiments, the system also includes a subsea separator connected to the manifold.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of drilling and producing from an offshore structure, comprising:

drilling a first well from the offshore structure with a drilling riser;

completing the first well with a first subsurface tree;

connecting the first subsurface tree to a manifold;

drilling a second well from the offshore structure with the drilling riser;

completing the second well with a second subsurface tree;

connecting the second subsurface tree to the manifold;

connecting the manifold to a subsea boosting system comprising a caisson, an electrical submersible pump, an annular degasser, and a production riser, wherein the caisson comprises at least one length of straight tubular and at least one length of tapered tubular; and connecting the production riser to the offshore structure.

2. The method of claim 1, further comprising flowing at least a portion of produced gases through a first opening in the production riser.

3. The method of claim 1, further comprising flowing at least a portion of produced fluids through a second opening in the production riser.

4. The method of claim 1, further comprising drilling with a surface blow out preventer.

5. The method of claim 1, wherein the offshore structure is floating.

6. The method of claim 1, wherein the offshore structure is selected from a tension leg platform, a semi submersible, and a spar.

7. A method of producing from an offshore structure, comprising:

drilling a first well from a drill ship;

completing the first well with a first subsurface tree;

connecting the first subsurface tree to a manifold;

drilling a second well from the drill ship;

completing the second well with a second subsurface tree;

connecting the second subsurface tree to the manifold;

connecting the manifold to a subsea boosting system comprising a caisson, an electrical submersible pump, an annular degasser, and a production riser, wherein the caisson comprises at least one length of straight tubular and at least one length of tapered tubular; and connecting the production riser to the offshore structure.

8. The method of claim 7, wherein the offshore structure is floating.

9. The method of claim 7, wherein the offshore structure is selected from a tension leg platform, a semi submersible, and a spar.

10. A system for drilling and producing oil and/or gas, comprising:

an offshore structure located in a body of water;

a first well comprising a first subsurface tree;

a second well comprising a second subsurface tree;

a manifold connected to the first well and the second well; and a subsea boosting system connected to the manifold, the subsea boosting system comprising a caisson, an electrical submersible pump, an annular degasser, and a production riser, the production riser connected to the offshore structure, wherein the caisson comprises at least one length of straight tubular and at least one length of tapered tubular.

11. The system of claim 10, further comprising a drilling riser connected to the offshore structure and a third well.

* * * * *